United States Patent [19]

Sunter

[11] 3,955,483

[45] May 11, 1976

[54] QUICK MOUNTING MEANS FOR GRILLES

[75] Inventor: Raymond B. Sunter, St. Petersburg, Fla.

[73] Assignee: Sunbros Corporation, St. Petersburg, Fla.

[22] Filed: Sept. 17, 1974

[21] Appl. No.: 506,712

[52] U.S. Cl. ..... 98/114; 98/108

[51] Int. Cl.[2] ..... F24F 13/00

[58] Field of Search ..... 98/114, 121 R, 40 V, 98/101, 102, 103, 104, 105, 106, 107, 108, 109, 110, 111, 112; 248/356, 226 B, 205 R; 220/343; 211/123, 124; 49/57; 52/507

[56] References Cited

UNITED STATES PATENTS

| | | | |
|---|---|---|---|
| 261,476 | 7/1882 | Neracher | 98/101 |
| 524,310 | 8/1894 | Cohen | 98/114 |
| 1,799,308 | 4/1931 | Matthiesen et al. | 52/507 |
| 2,593,133 | 4/1952 | Geary | 98/101 |
| 2,868,102 | 1/1959 | Melgaard | 98/114 X |
| 3,203,338 | 8/1965 | Dry | 98/110 X |
| 3,220,079 | 8/1965 | Aggson | 52/204 |
| 3,504,618 | 4/1970 | Rosner | 98/108 |

FOREIGN PATENTS OR APPLICATIONS

| | | | |
|---|---|---|---|
| 562,152 | 6/1944 | United Kingdom | 98/110 |

*Primary Examiner*—William F. O'Dea
*Assistant Examiner*—Harold Joyce
*Attorney, Agent, or Firm*—Christen & Sabol

[57] ABSTRACT

A quick mounting and dismounting grille for ventilator shaft openings or the like which includes a ventilator grille, a mounting means for mounting the ventilator grille in a ventilator shaft opening or the like, the mounting means utilizing inward or outward spring pressure to achieve the mounting, and at least one clip means. The mounting means is mounted in the clip means. The clip means is detachably affixed to appendages, walls, vanes or the like on the backside of the mounting means by the inward spring lever pressure of the end portions of the two legs of the clip means.

1 Claim, 8 Drawing Figures

FIG. 5
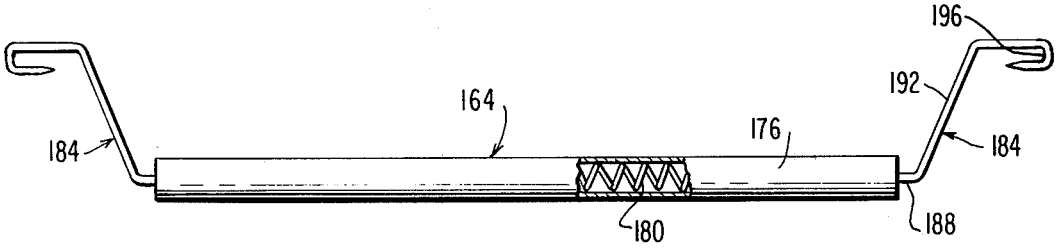
FIG. 6
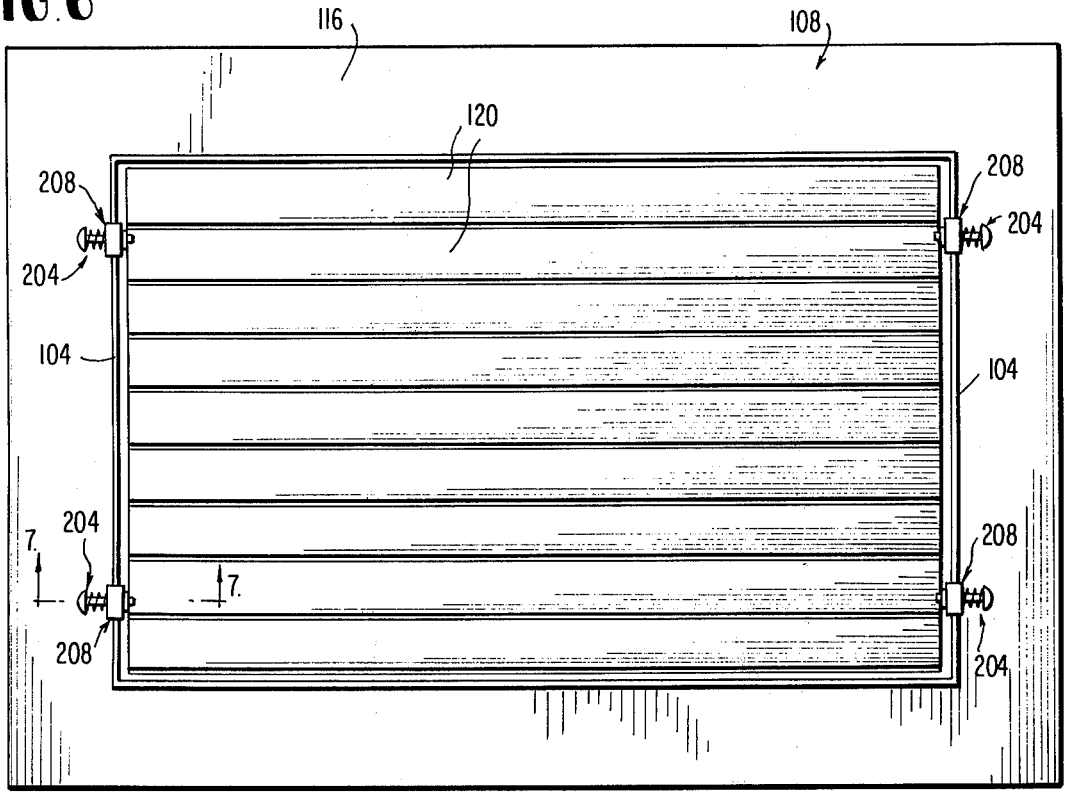
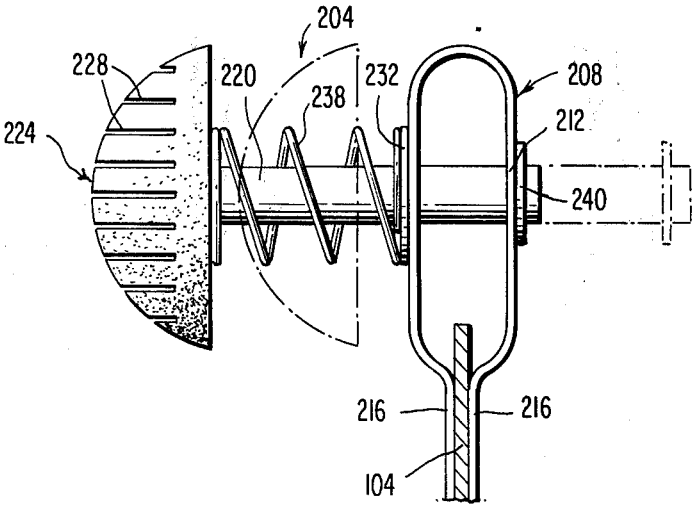
FIG. 7

QUICK MOUNTING MEANS FOR GRILLES

BACKGROUND OF THIS INVENTION

1. Field of this Invention

This invention relates to detachable mounting ventilation for ventilator grilles and to quick mounting grilles for ventilation shafts.

2. Prior Art

U.S. Pat. No. 3,203,338 teaches the use of magnets to hold grilles in ventilator shaft openings. The use of magnets has the serious disadvantage that magnets lose their effectiveness with time and have to be replaced. Besides, magnets are relatively expensive. The magnets shown are not detachable, but are bolted or the like to the grille (which involves expensive and time-consuming adaptation of the grilles).

U.S. Pat. No. 3,220,079 discloses four ∧- shaped flanges on the back side of a grille which snugly mate with the walls of a vent opening. The flanges are part of the grille structure, which means that special grilles must be manufactured. Same for the bent back lips on the edges of the vent opening.

U.S. Pat. No. 261,476 teaches the use of spring leafs which are screwed onto the main damper body.

U.S. Pat. No. 1,799,308 teaches self-adjusting screen door grilles which use adjustable vertical strips. Such strips are attached to the main screen door grille body on its sides by means of coil spring means which was affixed to the strips and the grill body by inserting holes drilled in both and screws inserted into the buried portions of the coil spring means.

U.S. Pat. No. 524,310 discloses the use of bent wire springs that are in essence essentially permanently affixed to the register—see FIG. 3.

BROAD DESCRIPTION OF THIS INVENTION

An object of this invention is to provide a quick mounting grille or the like for ventilators or the like. Another object of this invention is to provide mounting means for a grille ventilator which can be quickly and easily mounted on and can be quickly and easily detached from the grille. A further object of this invention is to provide a mounting means which can be used when there are slight variations in the dimensions of the planar section of the ventilator openings. A still further object of this invention is to provide a simple, inexpensive, convenient, easy-to-use, and easy-to-make detachable mounting means for ventilator grilles. A further object of this invention is to provide a quick mounting grille and mounting means which do not utilize screws, bolts, nails or the like to effect the mounting. Another object of this invention is to provide mounting means which can be detachably attached to the grille without any expensive and time-consuming adaptation or modification of the grille.

Other objects and advantages of this invention are set out below or are obvious to one ordinarily skilled in the art from this specification and the attached claims and drawings.

The quick mounting grille and detachable mounting means of this invention achieves the objects of this invention.

This invention involves a quick mounting and dismounting grille for ventilator shaft openings or the like. It includes a ventilator grille, a mounting means for mounting the ventilator grille in a ventilator shaft opening or the like, the mounting means utilizing inward or outward spring pressure to achieve the mounting, and at least one clip means. The mounting means is mounted in the clip means. The clip means is detachably affixed to appendages, walls, vanes or the like on the backside of the mounting means by the inward spring lever pressure of the end portions of the two legs of the clip means.

One embodiment of this invention involves a mounting means which includes a tube, open at one end and closed at the other end, a shaft slidably mounted in the tube, and a spring located in the tube. The spring forces the shaft outwardly so that the ends of the mounting means are firmly pressed against walls of the ventilator shaft opening thereby holding the grille in place. Preferably a flexible or elastic end portion is mounted on the outer end of the tube and on the outer end of the shaft. Preferably rubber nipples are mounted on the end of the end portions. Preferably two of the mounting means are detachably attached to the grille. Preferably the clips contain a body portion which snugly fits around the tube.

Another embodiment of this invention involves a mounting means which includes a tube, a tension spring slidably mounted in the tube, and an arm member mounted on each end of the tension spring and which each hook over a lip of the outside rim or facing of the ventilator shaft opening. The clip means contains a body means which snugly fits around the tube and holds the mounting means enough away from the appendage of the grille so that the arms can be moved and can extend to the edges of the grilles in order to allow hooking over the lips of the ventilator shaft opening.

A further embodiment of this invention includes a clip means which also contains an elongated body means extending from the two legs. The mounting means include a shaft which slidably extends through a hole or holes in the clip. An elastic or rubber tip or end portion is located on the end of the shaft away from the clip. A spring is fixed over the shaft, one end of which rests against the end portion and the other against the clip. Stop means is located on the opposite end of the shaft to keep the spring from forcing the shaft out of the hole or holes in the clip. Preferably the end portion contains a series of grooves therein. Preferably four of the clips and four of the mounting means are used to mount the grille. Preferably a washer is slidably mounted on the shaft between the spring and the clip.

The quick mounting means of this invention can be used on grilles and/or registers for openings such as ventilators, wall vents, foundation vents, hot and cold air vents, etc.; all conveniently herein termed ventilators. The grilles or registers can be shuttered or have another similar dampening means for regulating the amount of air or the like in the ventilators.

The quick mounting means is quickly and easily detachable from the grille and can quickly and easily be mounted on the grille. No cumbersome and time-consuming nails, screws and bolts need be used or hole drilling need be done when this invention is used. No misalignment is involved with this invention as is when screw mounting holes are used to effect conventional mounting of grilles. The spring has arrangement of all three embodiments of this invention allows the mounting means of each to be when there are slight variations in the dimensions of the planar section of the ventilator openings.

This invention includes the method of using the quick mounting means for grilles of this invention.

DETAILED DESCRIPTION OF THIS INVENTION

In the drawings:

FIG. 5 is a top elevational view of the mounting means shown in the ventilator shaft opening in FIG. 1;

FIG. 6 is a back elevational view of another embodiment of this invention;

FIG. 7 is a side elevational view of the mounting means shown in FIG. 6 along lines 7—7.

Figure 1:
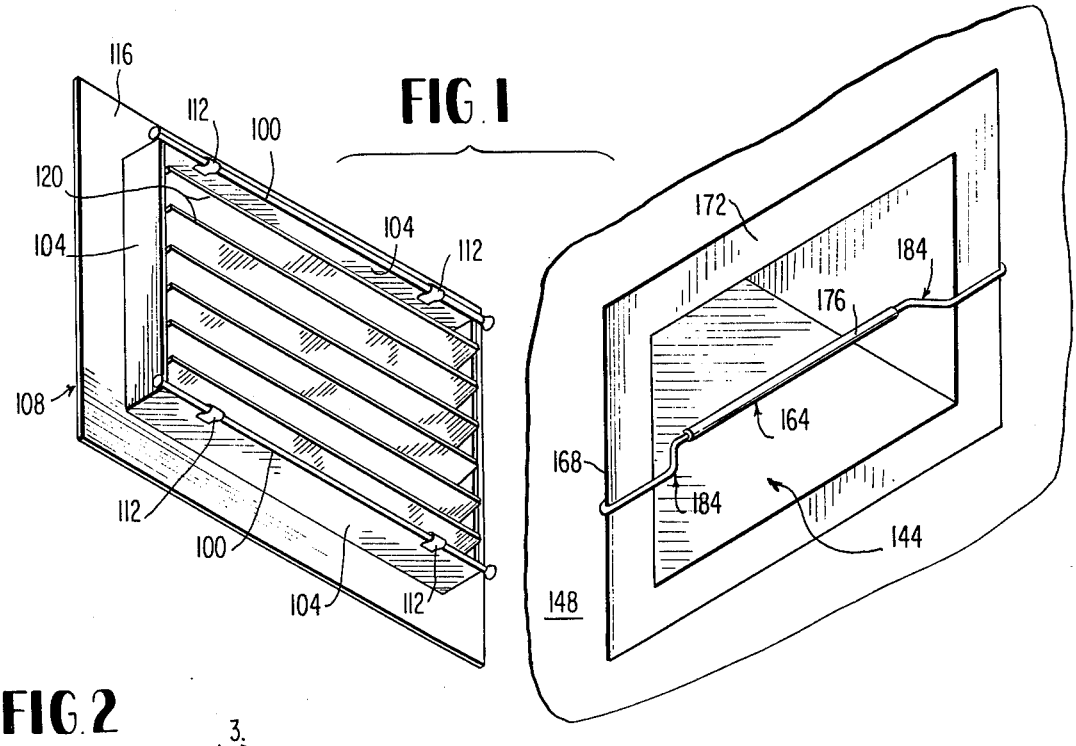
FIG. 1 is a perspective view of the backside of a grille containing one embodiment of this invention and a ventilator shaft opening containing another mounting means of this invention.
Figure 2:
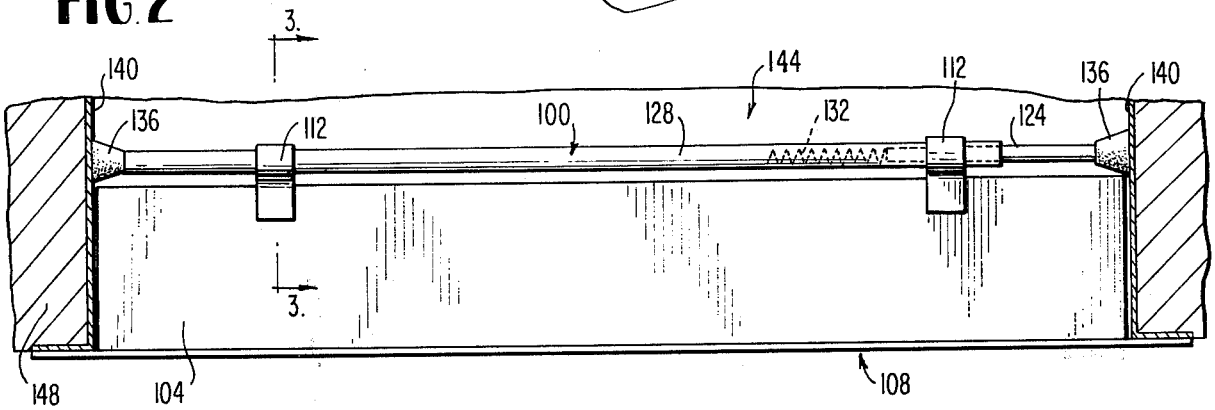
FIG. 2 is a top elevational view of the embodiment of this invention shown attached to the grille in FIG. 1.
Figure 3:
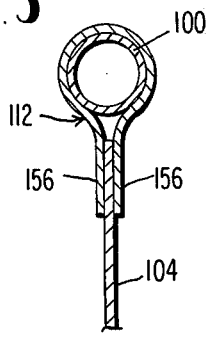
FIG. 3 is a cross-sectional view along lines 3—3 in FIG. 2.
Figure 8:
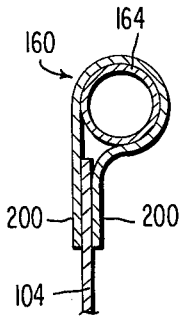
FIG. 8 is a cross-sectional view of the clip used to detachably mount the mounting means on FIG. 5 on a grille.
Figure 4:
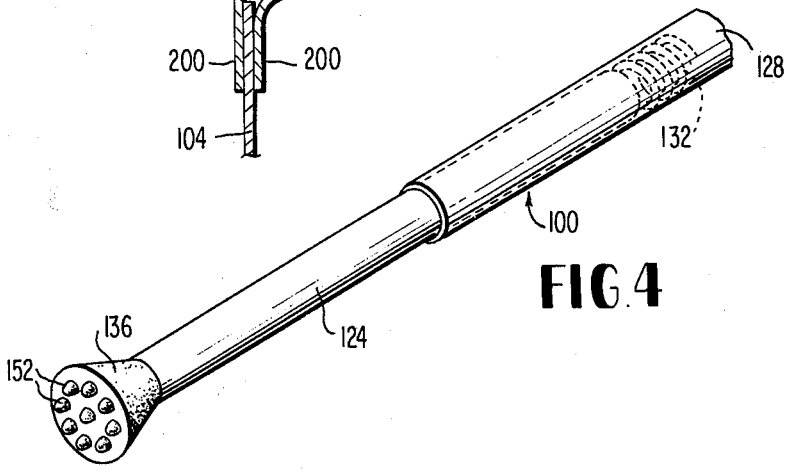
FIG. 4 is a partial perspective view of the mounting means shown in FIG. 2.

Mounting units 100 are detachably attached to walls 104 of grille 108 by means of clips 112. See FIG. 1. Grille 108 also includes front plate 116 (which has a hole corresponding to walls 104) and slats 120. Walls 104 are perpendicular to front plate 116. Mounting unit 100 includes shaft 124 slidably mounted in tube 128 (see FIG. 2). Compression spring 132 contained in tube 128 outwardly pushes shaft 124, thereby holding end portions 136 against the side walls (140) of ventilator shaft opening 144 (set in wall 148). The opposite end of tube 128 is closed. The bottom or outer face of each end portion 136 contains a number of rubber nipples 152. End portions 136 should be made of rubber or other elastic material. Shaft 124 and tube 128 can be made of metal, plastic, wood, etc. Clips 112 are best shown in FIG. 3. Clips 112 have a body portion which snugly fits around mounting unit 114 (as shown in FIG. 3) and parallel leaf or lever spring portions 156 which fit with inward pressure onto the edge of wall 104 (see FIG. 3). (Clips 160 can be used in place of clips 112.)

After one or more (preferably two) mounting units 100 are placed on walls 104 by means of clips 112, grille 108 is inserted (quickly mounted) in ventilator shaft opening 144. Springs 132 hold grille 108 in place and allow for a slight variation in the dimensions of ventilator shaft opening 144. Rubber nipples 152 help hold grille 108 in place.

Mounting units 100 can be of any length and diameter as needed for different sized grilles. Shafts 124 and tubes 128 can have any cross-sectional shape which allows the necessary sliding motion.

Mounting unit 164 is attached over lip 168 of facing plate 172 of ventilator shaft opening 144. See FIG. 1. Mounting unit 164 is mounted onto walls 104 of grille 108 by means of clips 160 in a manner similar to that shown for mounting units 100 in FIG. 2. As best shown in FIG. 5, mounting unit 164 includes tube 176 and compression spring 180, which is located in tube 176. Arms 184 are attached to the ends of spring 180. Arms 184 have straight portion 188, slanted portion 192 and hook portion 196. The ends of hook portions 196 are preferably pointed or chisel-shaped so as to easily fit between facing plate 172 and wall 148. Clips 160 have a body portion which snugly fits around tube 176 and parallel leaf or lever spring portions 200 which fit with inward pressure onto the edge of wall 104. The body portion of clip 160 is offset from the plane of wall 104 so that arms 184 can freely move in and out during the mounting and dismounting of grille 108.

After one or more mounting units 164 are placed on wall or walls 104 by means of clips 160, grille 108 is inserted into ventilator shaft opening 144—hook portions 196 are hooked over lip 168. Spring 180 holds grille 108 in place and allows for a slight variation in the dimensions of ventilator shaft opening 144 and face 172.

Tubes 176 can be made of wood, plastic, steel, etc. Mounting units 164 can have any length as needed for different sized grilles.

Mounting means 204 are each attached to walls 104 by means of clips 208. See FIG. 6. In a sense mounting means 204 and clips 208 are integral with each other. See FIG. 7. Clips 208 have elongated body portion 212, and parallel leaf or spring portions 216 which fit with inward pressure onto the edge of walls 104. Elongated body portion 216 has two facing wall portions (as shown) which each have a hold through which shaft 220 slidably fits. Rubber or elastic tip 224 fits on the end of shaft 220 away from clip 208. Tip 224 has parallel grooves 228 in its face. Tip 224 preferably has a convex shaped face. Washer 232 slidably fits over shaft 220 and rests against clip 208. Coil tension spring 236 fits around shaft 220 between (metal or plastic) washer 232 and tip 224. Ring 240 is fixedly attached to the end of shaft 220 which extends through the holes in clip 208. FIG. 7, by means of the dotted lines, shows mounting means 204 in its position when grille 108 is mounted in ventilator shaft opening 144.

After one or more (preferably two and most preferably four, two on each of two opposing sides) mounting units 204 and clips 208 are placed on walls 104, grille 108 is inserted into ventilator shaft opening 144. Springs 220 hold grille 108 in place and allow for a slight variation in the dimensions of ventilator shaft opening 144. Rubber end portions 224 help hold grille 108 in place—the face of rubber end portions 224 is squashed when grille 108 is in place.

What is claimed is:

1. A quick mounting and dismounting grill for ventilator shaft openings or the like which comprises (i) a ventilator grille, (ii) a mounting means for mounting said ventilator grille in a ventilator shaft opening or the like, said mounting means utilizing inward spring pressure to achieve said mounting, and said mounting means comprising a tube, a tension spring slidable mounted in said tube, and an arm member mounted on each end of said tension spring and which each hook over a lip of the outside rim or facing of said ventilator shaft opening, and (iii) at least one clip means wherein said mounting means is mounted and which is detachably affixed to appendages, walls, vanes or the like on the backside of said ventilator grille by the inward spring lever pressure of the end portions of the two legs of said clip means, said clip means containing a body means which snugly fits around said tube and holds said mounting means enough above said appendages of said grille so that said arms can be moved and can extended to the edges of said grilles in order to allow hooking over said lips of said ventilator shaft opening.

* * * * *